US005937606A

United States Patent [19]

Meier et al.

[11] Patent Number: 5,937,606

[45] Date of Patent: Aug. 17, 1999

[54] SECURING OF REINFORCING STRIPS

[75] Inventors: Urs Meier, Schwerzenbach; Martin Deuring, Winterhur; Gregor Schwegler, Lucerne, all of Switzerland

[73] Assignee: Eidgenossische Materialprufungs-Und Forschungsanstalt EMPA, Dubendorf, Sweden

[21] Appl. No.: 08/860,596

[22] PCT Filed: Dec. 12, 1995

[86] PCT No.: PCT/CH95/00298

§ 371 Date: Nov. 24, 1997

§ 102(e) Date: Nov. 24, 1997

[87] PCT Pub. No.: WO96/21785

PCT Pub. Date: Jul. 18, 1996

[30] Foreign Application Priority Data

Jan. 9, 1995 [CH] Switzerland ..... 45/95

[51] Int. Cl.[6] ..... E04C 5/00

[52] U.S. Cl. ..... 52/600; 52/422; 52/415

[58] Field of Search ..... 52/432, 422, 434, 52/435, 772, 249, 415, 600, 223.6, 223.7, 514

[56] References Cited

U.S. PATENT DOCUMENTS

| | | | |
|---|---|---|---|
| 3,900,102 | 8/1975 | Hurst | 52/415 |
| 4,396,665 | 8/1983 | Rowe | 52/415 |
| 4,534,924 | 8/1985 | Kariakin | 264/259 |
| 5,055,330 | 10/1991 | Stahl et al. | 428/61 |
| 5,197,245 | 3/1993 | Davis | 52/223 |
| 5,398,472 | 3/1995 | Eichelkraut | 52/443 |
| 5,542,563 | 8/1996 | Matias | 200/470 |
| 5,566,509 | 10/1996 | Long | 49/462 |

*Primary Examiner*—Carl D. Friedman
*Assistant Examiner*—Dennis L. Dorsey
*Attorney, Agent, or Firm*—Notaro & Michalos P.C.

[57] ABSTRACT

An arrangement and method for reinforcing a structural component utilizes an elongated strip or lamina which is applied to the surface of the structural component and which has at least one end which submerges into a recess in the surface of the component and is anchored in that recess. This has been found to greatly increase the reinforcing effect of the strip on the structure.

14 Claims, 14 Drawing Sheets

3

SECURING OF REINFORCING STRIPS

FIELD AND BACKGROUND OF THE INVENTION

The present invention relates to an arrangement for reinforcement at a longitudinally and/or areally extending structure or structural component by means of at least one lamina-like reinforcement disposed on the structure or structural component or masonry, slacked or prestressed, a structural component provided for support functions, as well as a method for reinforcing a structure or structural component.

For many years research and practice has been engaged in the subsequent reinforcement of structures, such as in particular ferroconcrete structures and masonry by applying additional reinforcement. The beginnings of this technique are described in J. Bresson, "Nouvelles recherches et applications concernant l'utilisation des collages dans les structures. Beton plaqué.", Annales ITBTP No. 278 (1971), Série Beton, Beton armé No. 116, and go back to the 1960s. Bresson directed his efforts in particular to the research of the composite tension in the region of the anchorages of steel laminae affixed by adhesion.

For approximately the past twenty years, existing structures, such as ferroconcrete structures, such as for example bridges, floor and ceiling plates, longitudinal girders and the like, but also nonreinforced masonry, can consequently be reinforced through subsequent affixing by adhesion of steel laminae.

The reinforcing of concrete structures and masonry by affixing steel laminae with, for example, epoxy resin adhesives, can be considered to be standard technique at this time. There are a variety of reasons which make reinforcement necessary:

- increase of load capacity,
- change of static systems by removing, for example, bearing elements such as supports, or their support functions are reduced,
- reinforcement of structural components endangered by fatigue,
- increase of rigidity,
- damage of bearing systems or renovation of existing structures and of masonry, as well as
- faulty calculation or workmanship of the structures.

Subsequent reinforcement with steel laminae affixed by adhesion have been found to be useful on numerous structures such as is described for example in the following literature citations: Ladner, M., Weder, Ch.: "Geklebte Bewehrung im Stahlbetonbau" {*Adhered armouring in ferroconcrete construction*}, EMPA Dübendorf, Bericht No. 206 (1981); "Verstärkung von Tragkonstruktionen mit geklebter Armierung" {*Reinforcement of bearing structures with adhered armouring*}, Schweiz. Bauzeitung, Sonderdruck aus dem 92. Jahrgang, No. 10 (1974); "Die Sanierung der Gizenenbrücke über Muota" {*Renovation of the Gizen bridge across the Muota*}, Schweiz. Ingenieur & Architekt, Sonderdruck aus Heft 41 (1980).

However, these reinforcement methods entail disadvantages. Steel laminae can only be supplied in short lengths which only allows application of relatively short laminae. Consequently, laminar stacks become necessary and thus potential weak points, cannot be avoided. The awkward handling of heavy steel laminae on the site can in addition lead to especially difficult problems in implementation techniques in the case of high structures or those difficult to access. Moreover, in the case of steel, even with careful corrosion protection treatment, the danger of lateral concealed rusting of the laminae, or the corrosion on the interface between steel and concrete exists which can lead to the detachment and thus the loss of reinforcement.

Accordingly, it was suggested in the publication by U. Meier, "Brückensanierungen mit Hochleistungs-Faserverbundwerkstoffen" {*Bridge renovation with high-performance fiber composites*}, Material+Technik, Vol. 15, No. 4 (1987), and in the dissertation by H. P. Kaiser, Diss. ETH No. 8918 of the ETH Zürich (1989) to replace the steel laminae by carbon-fiber reinforced epoxy resin laminae. Laminae comprising this material are distinguished by a low bulk density, very high strength, excellent fatigue properties and outstanding corrosion resistance. It is thus possible to use, instead of the heavy steel laminae, light, thin carbon-fiber reinforced synthetic material laminae which can be transported virtually continuously in the rolled-up state to the construction site. It was found in practical determinations that carbon-fiber laminae of 0.5 mm thickness are capable of absorbing a tension force which corresponds to the yield force of a 3 mm thick FE360 steel lamina.

The stated carbon-fiber laminae have been found to be highly useful even when used for reinforcement of masonry in seismically hazardous zones. In Bericht {*Report*} 229 of the Eidgenössische Materialprüfungs- und Forschungsanstalt (EMPA) {*Swiss material testing and research institution*}, Dübendorf, by G. Schwegler with the title "Verstärken von Mauerwerk mit Faservebundwerkstoffen in seismisch gefährdeten Zonen" {*Reinforcement of masonry with fiber composites in seismically hazardous zones*} it is in particular suggested to reinforce existing masonry shear walls or walls in the facade region subsequently with fiber composite laminae. Therewith masonry can be decisively reinforced with respect to shearing and tension strength, compared to nonarmoured masonry. It is for example suggested therein to affix [by adhesion] the reinforcement laminae diagonally and crosswise on a shear wall, such as a facade wall, and it was found that for increasing the shearing resistance the terminal lamina anchoring, for example in concrete plates, is critical.

Particular attention must be paid in all described cases to the shearing fractures formation in the concrete or the masonry, respectively. Shearing fractures lead to an offset on the reinforced surface which, as a rule, leads to the peeling or detaching of the reinforcement laminae. The shearing fracture formation is thus also a significant assessment criterion with respect to the load capacity of the nonreinforced structural component as well as also a potential detachment danger of the subsequently applied reinforcement laminae.

The International Patent Application WO93/20 296 describes a method by means of which structural components intended for bearing functions are reinforced against shearing forces thereby that the above cited reinforcement laminae are each pressed by means of clamping elements in the terminal region margin onto the structure in order to prevent their detachment. The laminae are disposed such that the distance from the lamina end to the support or the concrete plates disposed terminally at shearing walls is as small as possible. The anchoring zone must be dimensioned such that the lamina tension force can be anchored and the transfer of the force to a support or to the margin of concrete plates of a shearing wall is ensured.

But it was found in practice that anchoring the reinforcement laminae in the region of the supports is not always possible due to concrete beam haunches and shoulders which leads to an increase of the distance. Even when reinforcing shearing walls it is most often difficult and expensive to anchor the reinforcement laminae in the concrete plates disposed on these walls above and below. Furthermore, for reasons of handling at the construction sites it is advantageous if reinforcement laminae do not need to be excessively long which results automatically if, for example, when reinforcing bridges reinforcement laminae must each extend from support to support.

SUMMARY OF THE INVENTION

It is therefore a task of the present invention to disclose how, with shortened anchoring lengths on reinforcement laminae, a largely constant reinforcement on structures can be achieved.

What is suggested is an arrangement for reinforcement on a longitudinally extending and/or areal structure or structural component by means of at least one lamina-like reinforcement disposed slacked or under prestress on the structure or structural component, wherein according to the invention the at least one lamina serving for reinforcement is anchored at least on one end extending into the structure or structural component.

It is therein suggested that at least the one lamina-end, preferably at least nearly continuously arched, is deflected for extending into the structure or masonry in order to be anchored in the structure or masonry.

In this way it is possible to attain, even with short anchoring lengths, a similar or nearly identical reinforcement on a structure or masonry as with relatively long practically from support to support and an anchoring of the lamina ends is possible in the region of the supports without encountering difficulties. Studies which will be discussed in further detail in the following with reference to the enclosed figures have shown that reinforcement laminae which are only disposed over a relatively short anchoring length with regard to the load introduction on the structure to be reinforced and which, according to the invention, have been anchored by projecting into the structural component, yield a nearly identical reinforcement on the structure as when the corresponding lamina end is anchored up to the region of the support.

It is understood that the suggested arrangement or anchoring, respectively, according to the invention of a lamina end such that it projects into the structure or masonry, respectively, is, suitable for any known reinforcement laminae, such as for example steel laminae, laminae reinforced by fiber glass or carbon fibers, for example produced with epoxy resins or polyester resins, extruded reinforcement laminae comprising a thermoplast, etc.

The at least one end of the reinforcement lamina or also both ends of the reinforcement lamina are preferably set into the structure extending at a constant arch wherein each of the set-in end can be covered by means of concrete and/or a polymer-reinforced material, such as in particular an adhesive agent. In the case of, for example, carbon-fiber reinforced epoxy resins, it is advantageous to use an epoxy mortar or an epoxy resin-reinforced concrete polymer, respectively, in order to anchor or cover, respectively, the end of the lamina set into the masonry or the concrete, respectively.

It is understood that it is also possible to press the lamina end projecting into the masonry or concrete structure, respectively, as suggested in WO93/20296, with a plate, lamina or truss-chord-like element against the structure or the structural component, respectively, in order to attain in this way a further reinforcement against occurring shearing forces. For this purpose is also suitable, for example, a wedge covering the lamina end.

Instead of these pressing means it is also possible to anchor the lamina end additionally by means of prestressed or non-prestressed mechanical fastening means, such as in particular bolts, rivets, pins, loops and the like in the structure or the structural component, respectively, or the masonry.

The arrangement suggested according to the invention is suitable for a structure or a structural component, respectively, intended for bearing functions, which is reinforced with one or several reinforcement laminae against occurring shearing forces. But also for the reinforcement of any structure or a masonry by means of one or several reinforcement laminae it is advantageous to anchor the lamina ends, such as is suggested according to the invention, such that it extends into the structure or structural component, respectively, or the masonry. It is for example possible when reinforcing masonry in seismically hazardous zones by means of GFK laminae to anchor the lamina ends such that they extend into the masonry, which makes superfluous the necessity to end for the purpose of anchorage the laminae into the concrete plates or cover plates, respectively, disposed terminally with respect to the masonry, which represents a significant simplification when applying such reinforcement laminae.

BRIEF DESCRIPTION OF THE DRAWINGS

In the following, for example with reference to the enclosed figures, the invention will be described in further detail.

In the Drawings.

DESCRIPTION OF THE PREFERRED EMBODIMENTS

Figure 1:
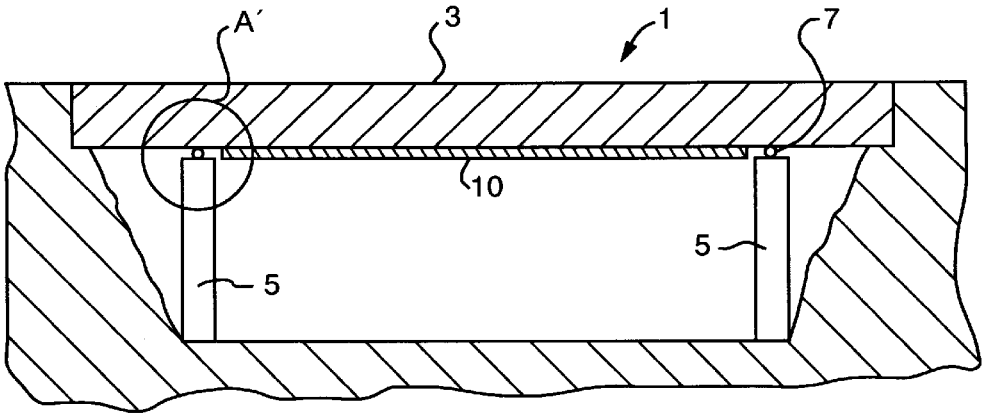
FIG. 1 (PRIOR ART)
FIG. 1 is a schematic longitudinal section of a concrete bridge reinforced by means of a reinforcement lamina.

FIG. 1, illustrates, schematically and in longitudinal section a reinforced concrete or ferroconcrete bridge 1, comprising a concrete plate 3 which is supported or held, respectively, by two piers 5 at the particular supports 7. Due to ageing this concrete bridge has been reinforced by means of a reinforcement lamina 10 disposed between the two supports 7. The reinforcement lamina 10 extends between the two supports 7 and is affixed by adhesion over its entire length, for example with an epoxy resin adhesive agent, wherein also in region A' the lamina, as is conventionally customary, is adhered terminally on the concrete plate 3. As suggested in WO 93/20296, it is possible additionally to anchor or press the lamina ends against the concrete plate 3 by means of additional truss-chords or steel plates.

Figure 2:
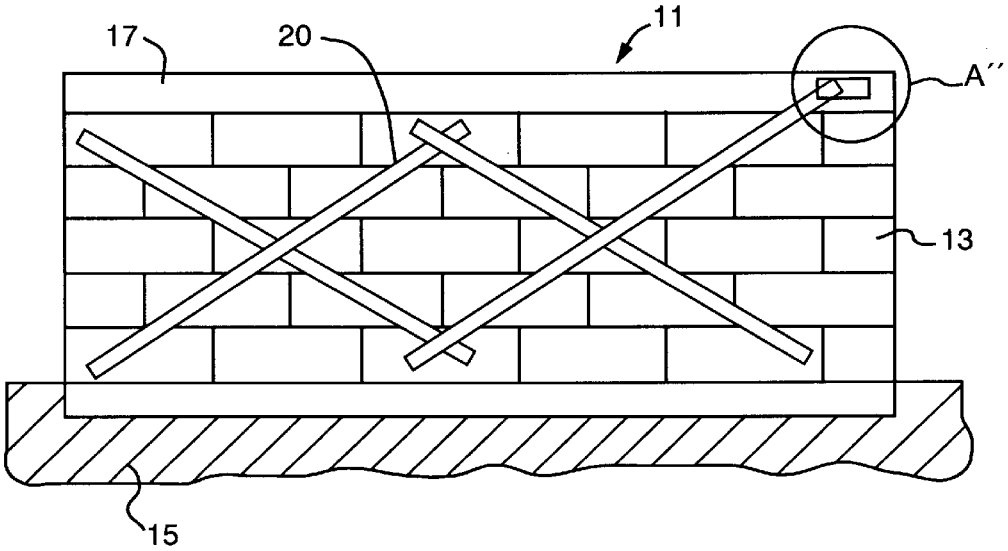
FIG. 2 (PRIOR ART)
FIG. 2 is a lateral plan view of a masonry or a shearing wall reinforced by means of reinforcement laminae, suitable for example for a seismically hazardous region.

FIG. 2 depicts a shearing wall 11 of a building, which is located in a seismically hazardous area. The masonry 13 is reinforced with laterally affixed [by adhesion] reinforcement laminae 20, wherein the laminae are in conventional manner anchored in the concrete plates or the bottom 15 and cover plate 17, disposed terminally below and above the shearing wall 13. The lamina end extends for example in the region A" into the concrete plate 17 in order to be anchored in it. The production of this anchoring is expensive and requires large work expenditures.

Figure 3:
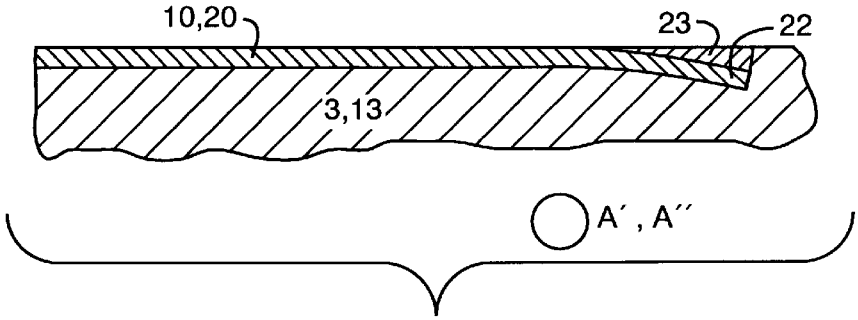
FIG. 3 is a schematic longitudinal section of the arrangement according to the invention and anchoring of a lamina end such that it extends into the masonry or structure, respectively.

FIG. 3 depicts the way in which, according to the invention, in regions A' or A", respectively, the lamina ends can be anchored simpler and more effectively. In this way, in region A' the lamina end does not need to extend into the proximity of support 7 and in region A" it is not absolutely necessary that the lamina end must extend into the concrete plate 17. As is evident in FIG. 3, the lamina end 22 of the reinforcement lamina 10 or 20, respectively, curves and extends into a recess in the surface of the concrete plate 3 or the masonry 13, respectively, and it is correspondingly covered in this region by concrete or cement mortar, respectively. It is understood that it is also possible to implement the coverage 23 by means of a polymer adhesive agent, such as for example an epoxy resin mortar or a polyurethane or silicon formation. The optimum selection of the material to be used is a function, for example, of the material of which the reinforcement lamina is fabricated. The end of the strip-like elongated lamina terminates at the end of the recess and is thus braced against the recess as shown in FIG. 3.

In conjunction with the following figures, it will be shown in the following that by inserting, shown schematically in FIG. 3, the lamina end into the structure or into the masonry, respectively, a decisive shearing reinforcement on the structure can be achieved even if the lamina length, not as usually required, is selected such that it extends from support to support or from concrete plate to concrete plate. With the experimental arrangement described in the following will in particular be shown that with identical lamina length an increase of the reinforcement can be attained if the lamina end(s) are anchored such that it (they) extend(s) into the structure or the structural component, respectively, or the masonry.

Figure 4A:
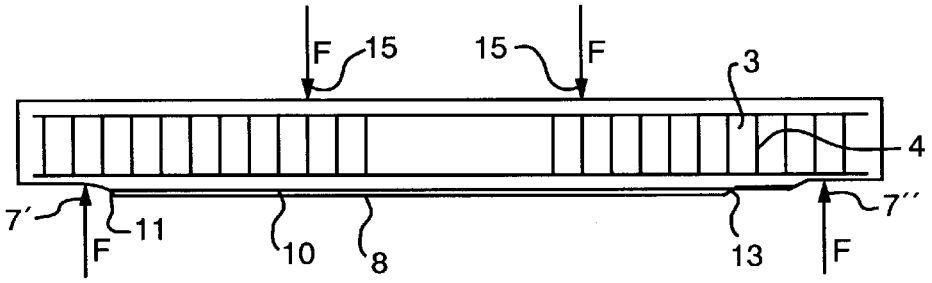
FIGS. 4*a* and 4*b* depict schematically and in longitudinal and transverse section respectively a concrete girder or an experimental arrangement, by means of which the terminal anchoring according to the invention is compared to a conventionally anchored lamina end.
Figure 4B:
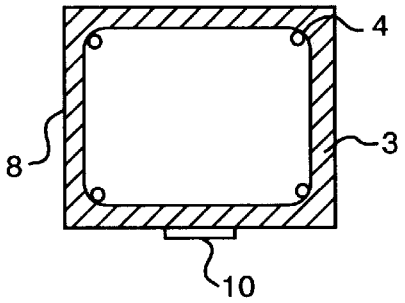

FIG. 4*a* shows in longitudinal section a concrete girder 3 analogous to that of FIG. 1, which is used for the following experimental arrangements. Concrete girder 3 rests on supports 7 and comprises a steel armouring 4. The concrete girder 3 has additionally been reinforced on its under side 8 by means of a CFK lamina 10 wherein the one end 11 of the lamina extends practically up to the corresponding support 7', while the opposing lamina end 13 is spaced apart from the other support 7". FIG. 4*b* shows the concrete girder from FIG. 4*a* in cross section.

The concrete girders shown schematically in FIGS. 4*a* and 4*b* were subjected to bending tests in conjunction with different experimental arrangements, wherein at the two sites 15 indicated by an arrow, a force F was introduced.

Figure 5A:
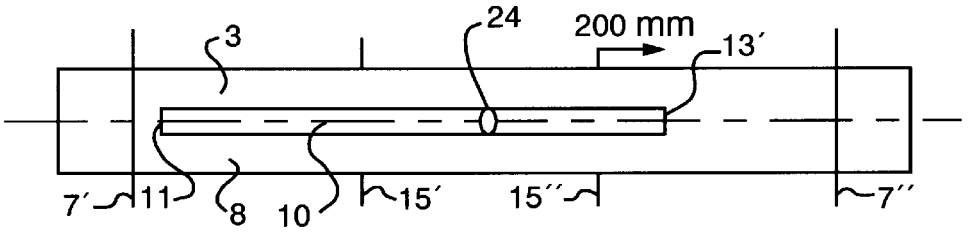
FIGS. 5*a* and 5*b* are respective bottom and detail views of an experimental arrangement with the concrete girder from FIG. 4 with a reinforcement lamina adhered conventionally.
Figure 5B:
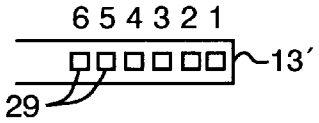

The experimental arrangement, shown in FIG. 5*a,* depicts the reinforcement lamina in plan view from below onto the concrete girder 3 to be reinforced, wherein the one lamina end 11 extends up to support 7' while the opposing lamina end 13' extends by a distance beyond the corresponding point of force introduction 15". The dimensioning of the experimental arrangement is shown in the representation of FIG. 5*a,* wherein the lamina end 13' extends correspondingly by 20 cm beyond the point of force introduction 15". In FIG. 5*b* are depicted schematically the measuring points 29 which are to be provided at the lamina end 13' for determining the forces occurring or the extension occurring, respectively. Site 24 in FIG. 5*a* marks the center of the concrete girder 3 at which also a measuring site is disposed.

In order to prevent failure of the lamina 10 in the region of end 11, further a (not shown) pressing plate is provided. The lamina end 13' is anchored affixed [by adhesion] in conventional manner on the underside of the concrete girder.

Figure 6A:
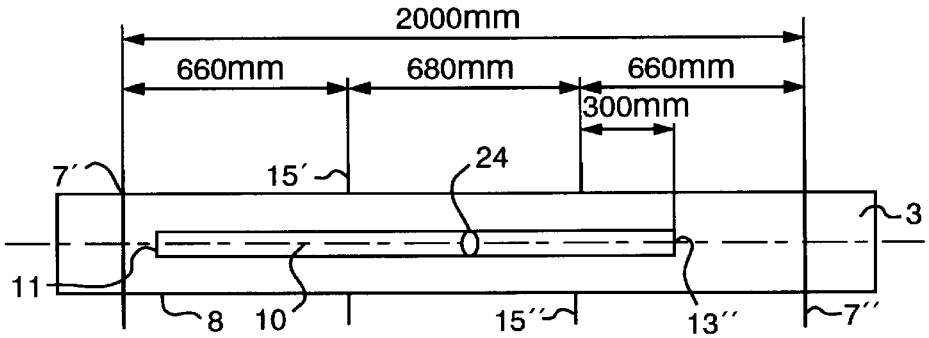
FIGS. 6*a* and 6*b* are analogous views to FIGS. 5*a* and 5*b,* showing an experimental arrangement as in FIGS. 4 and 5, however with an extended lamina end, FIGS. 7*a,* 7*b* and 7*c* are respective bottom, detail and sectional views of the same experimental arrangement as in FIGS. 4 to 6, however with one lamina end, such as suggested according to the invention, anchored such that it extends into the concrete girder.
Figure 6B:
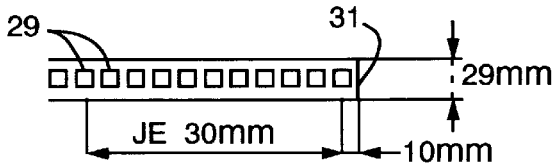

FIGS. 6*a* and 6*b* show an analogous experimental arrangement wherein, however, the lamina end 13" extends by 30 cm beyond the corresponding point of force introduction 15", and thus extends closer to the corresponding support 7". Again, in the region of end 13" several measuring sites are provided, as well as also centrally at site 24 on the concrete girder 3.

Figure 7A:
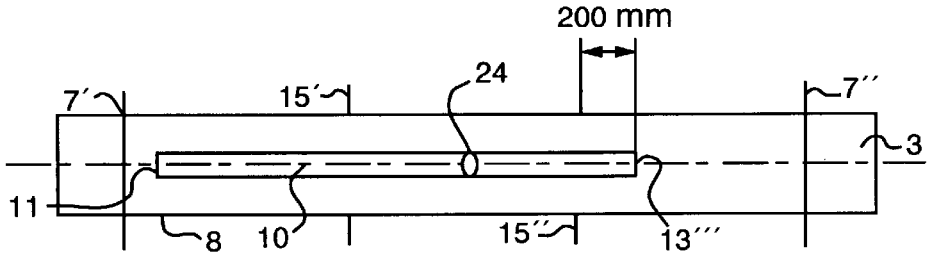
Figure 7B:
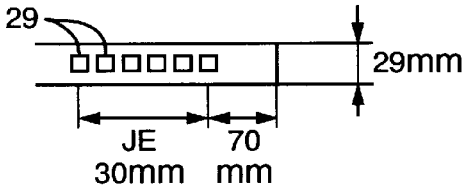
Figure 7C:
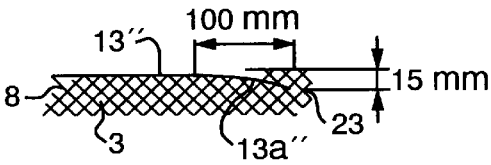

In FIG. 7 is depicted an experimental arrangement, wherein now the lamina end 13'" is anchored such that it extends into the structural component which is shown schematically in longitudinal section of FIG. 7*c*. The lamina end 13'" extends therein again only by 20 cm beyond the corresponding point of force introduction 15", thus is spaced apart by more than 10 cm from the corresponding support 7", compared to the experimental arrangement according to FIGS. 6*a* and 6*b*. The anchorage of the lamina end 13'" extends along a distance of 10 cm, wherein the FIG. 7*c* the continuously bent end piece 13*a'"* extending into the concrete girder 3 is shown schematically in longitudinal section. Over the lamina in region 23 in the anchoring zone of the end segment 13*a'"* an epoxy resin mortar was applied. Again in FIG. 7*b* schematically several measuring sites 29 are depicted, which have been disposed on lamina 10. Also at site 24 in the center of the concrete girder 3 a measuring site was disposed on the reinforcement lamina 10.

Figure 8:
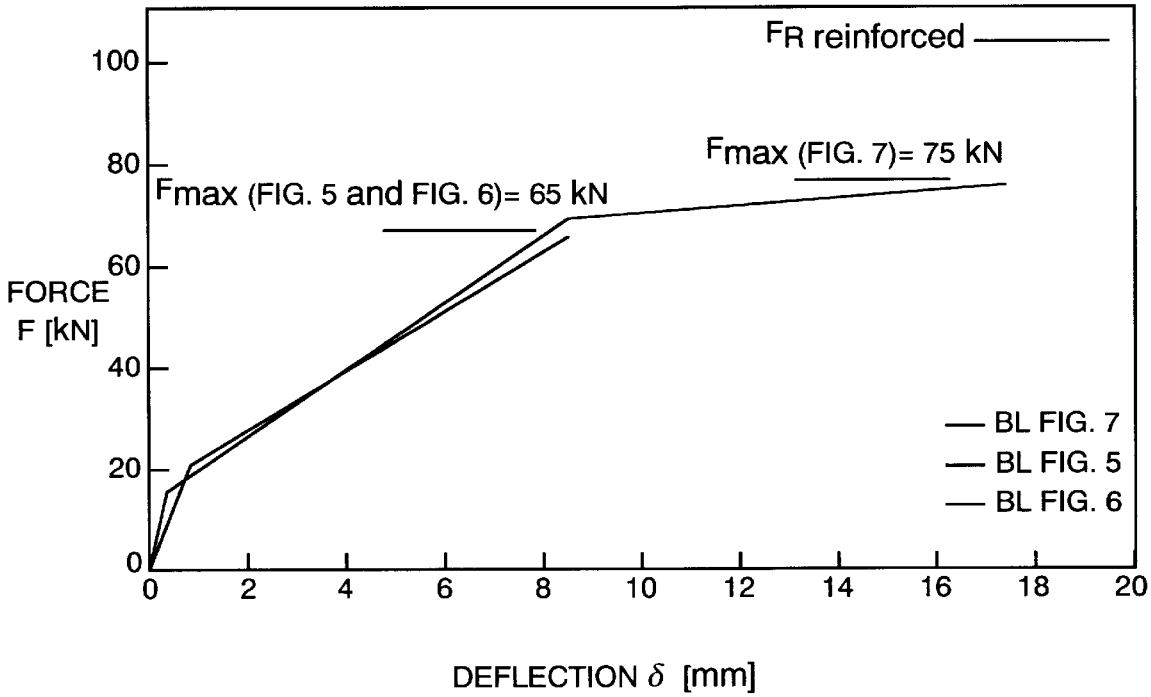
FIGS. 8 is a diagram the load deflection in the three experimental arrangements according to FIGS. 5, 6 and 7, FIGS. 9*a* and 9*b* are graphs illustrating lamina extension at the lamina end at different force stages and in the girder center in the experimental arrangement according to FIG. 5, FIGS. 10*a* and 10*b* are graphs illustrating extension at the lamina end at different forces stages and in the in the experimental arrangement according to FIG. 6, FIGS. 11*a* and 11*b* are graphs illustrating extension at the lamina end at different force stages and in the girder center in the experimental arrangement according to the invention according to FIG. 7, FIGS. 12*a* and 12*b* show schematically in longitudinal section and plan views respectively a method for anchoring according to the invention, a lamina end.

FIG. 8 shows in the form of a diagram the load deflection of the experimental girders measured in the center of the girder with the experimental arrangement used according to FIGS. 5, 6 and 7. The deflection δ (mm) is shown as a function of the force (KN) introduced at sites 15, wherein segregated by extension it is shown for the three experimental arrangements of FIGS. 5, 6 and 7.

Figure 9A:
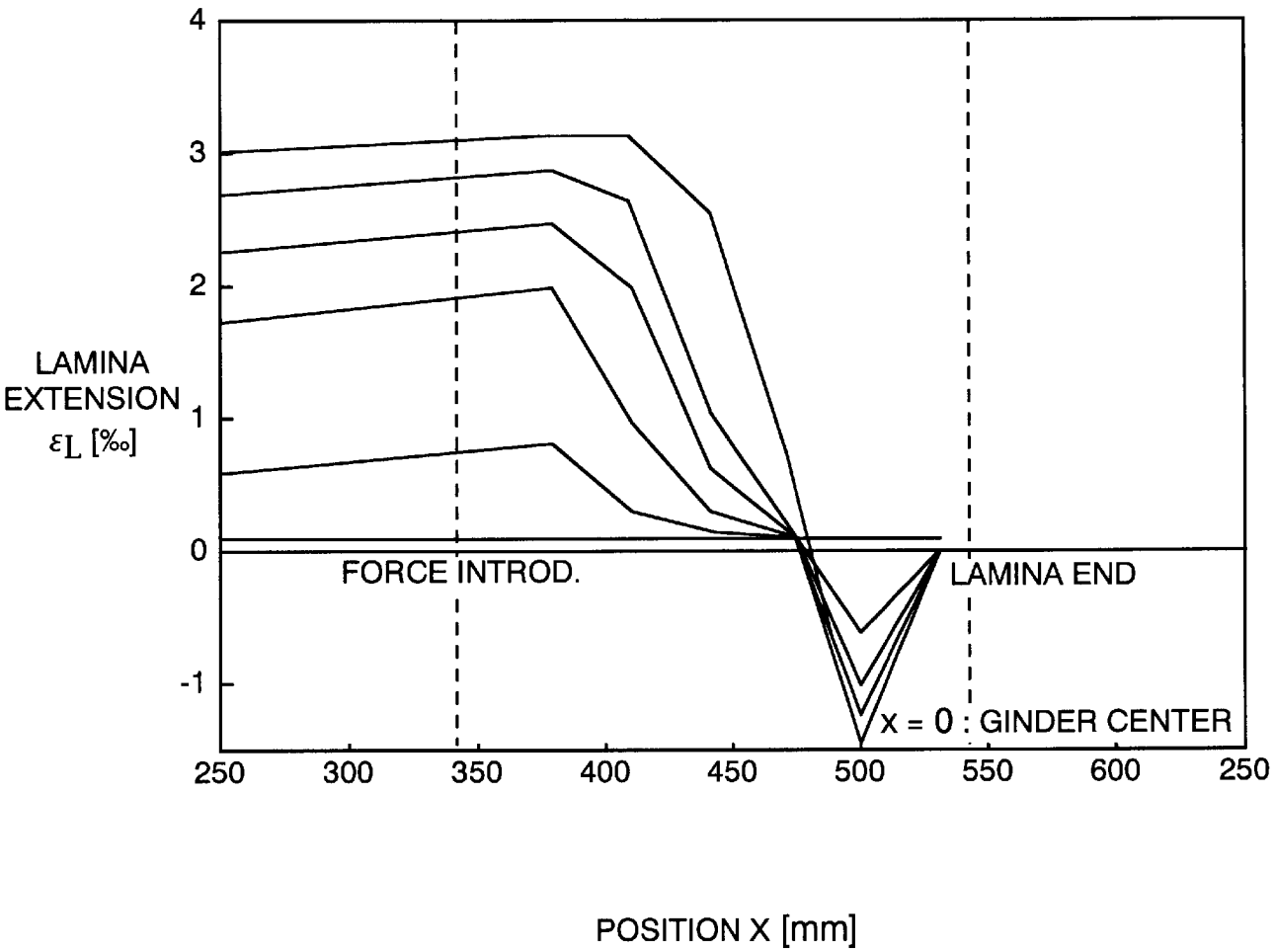
Figure 9B:
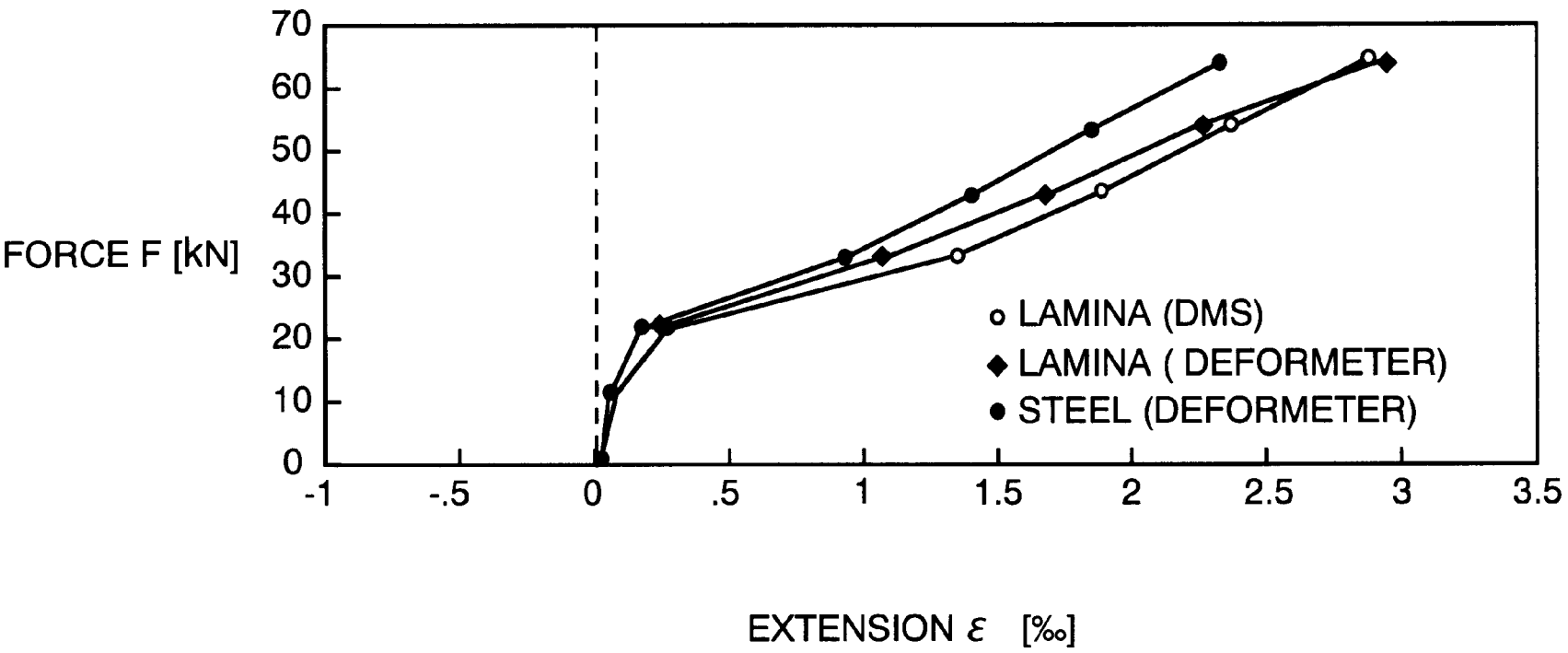
Figure 10A:
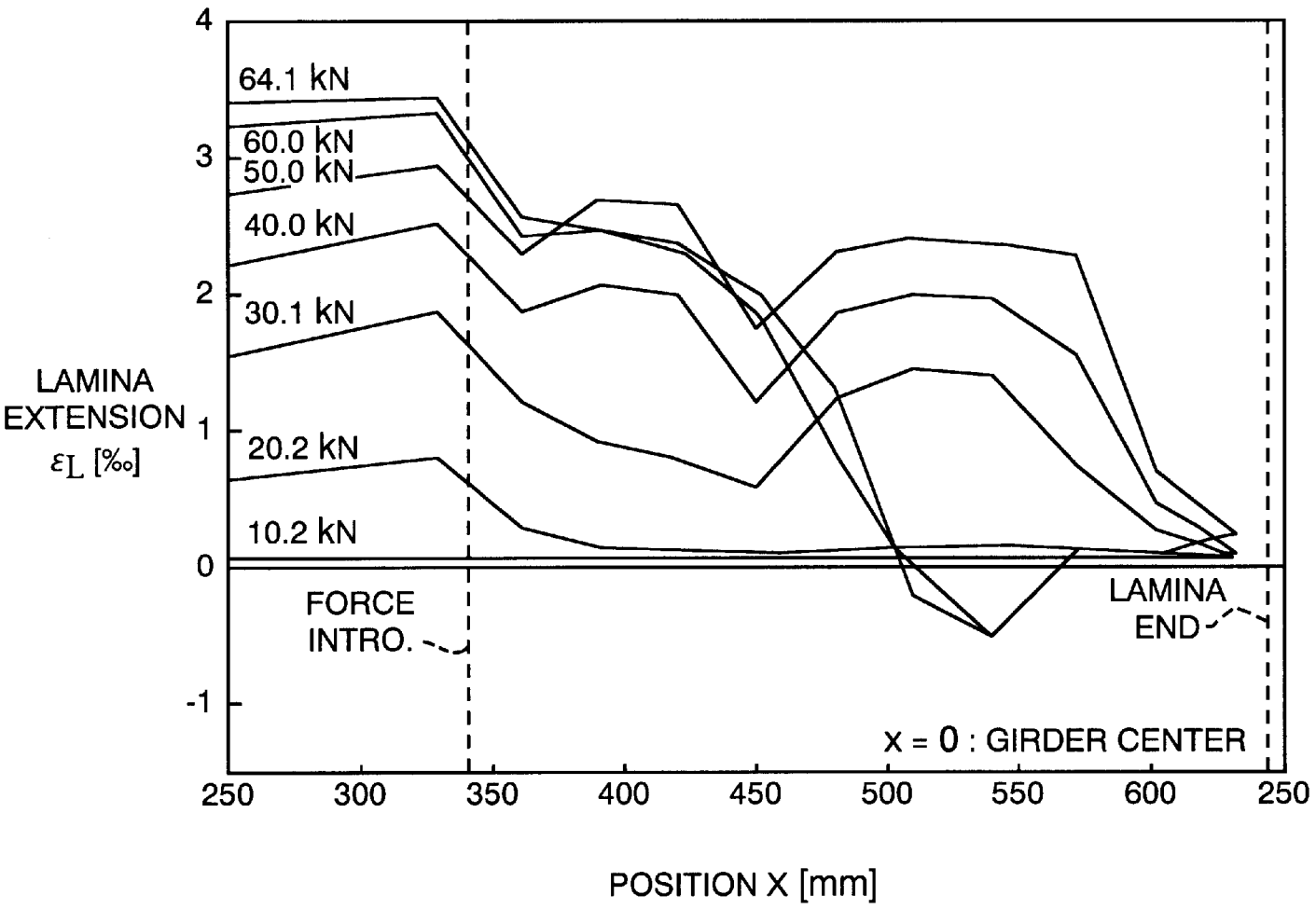
Figure 10B:
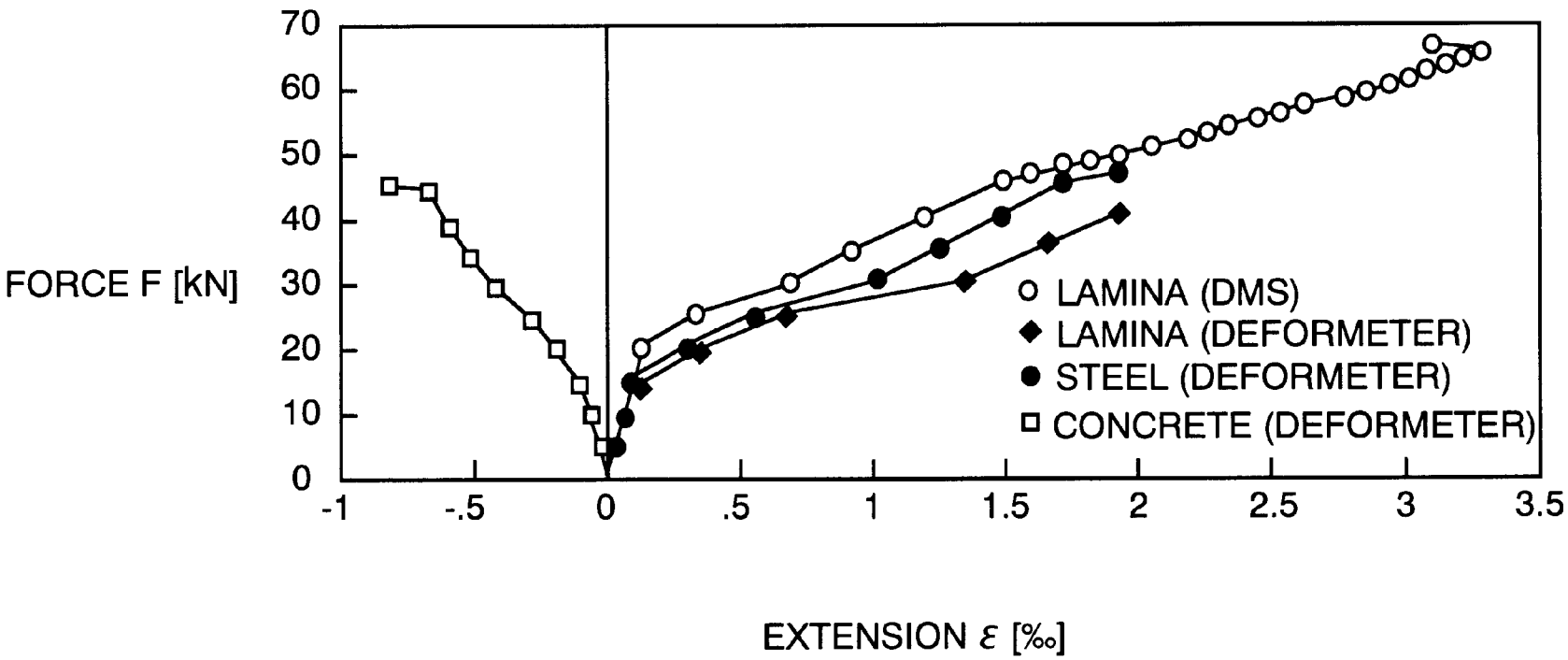
Figure 11A:
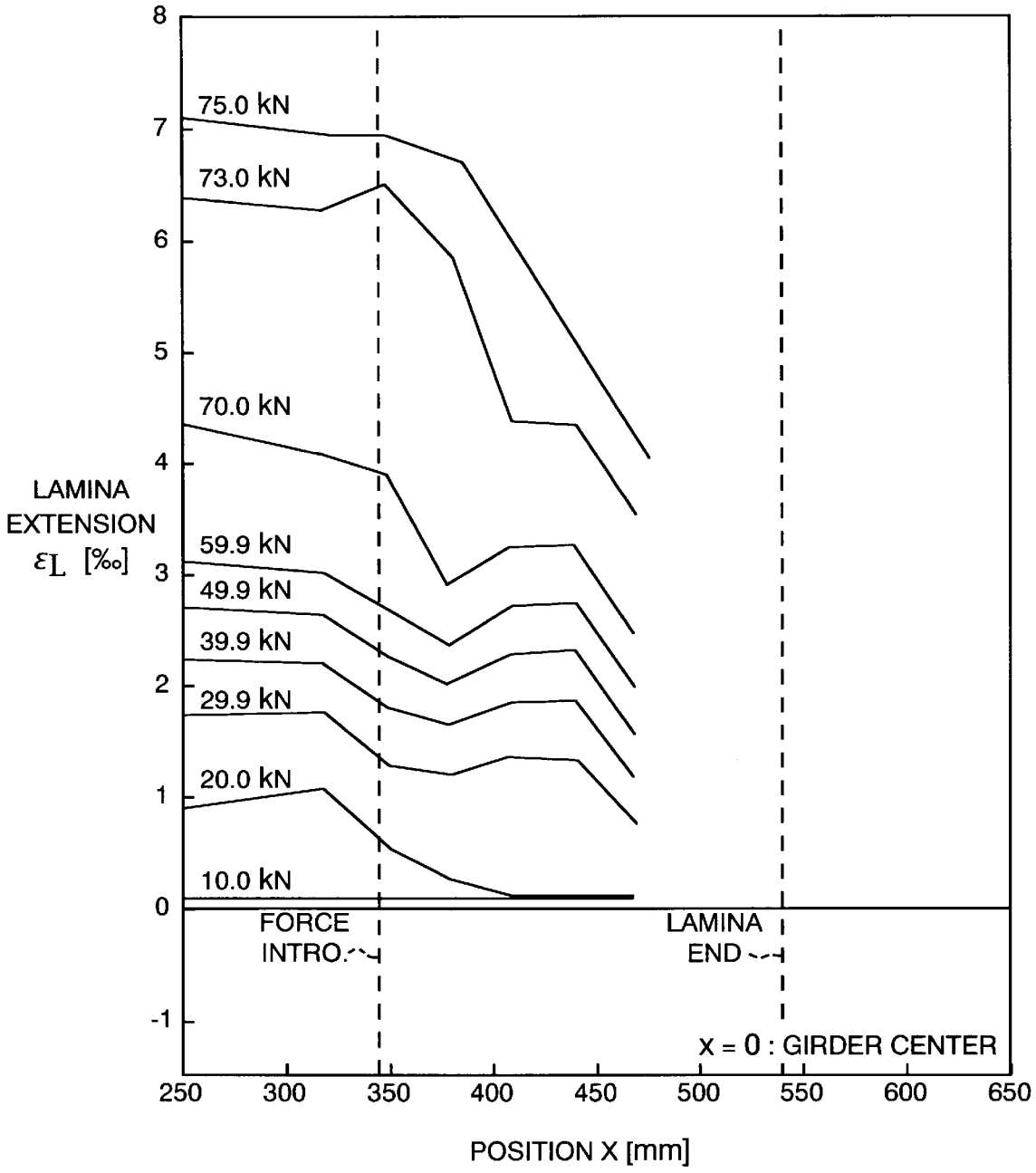
Figure 11B:
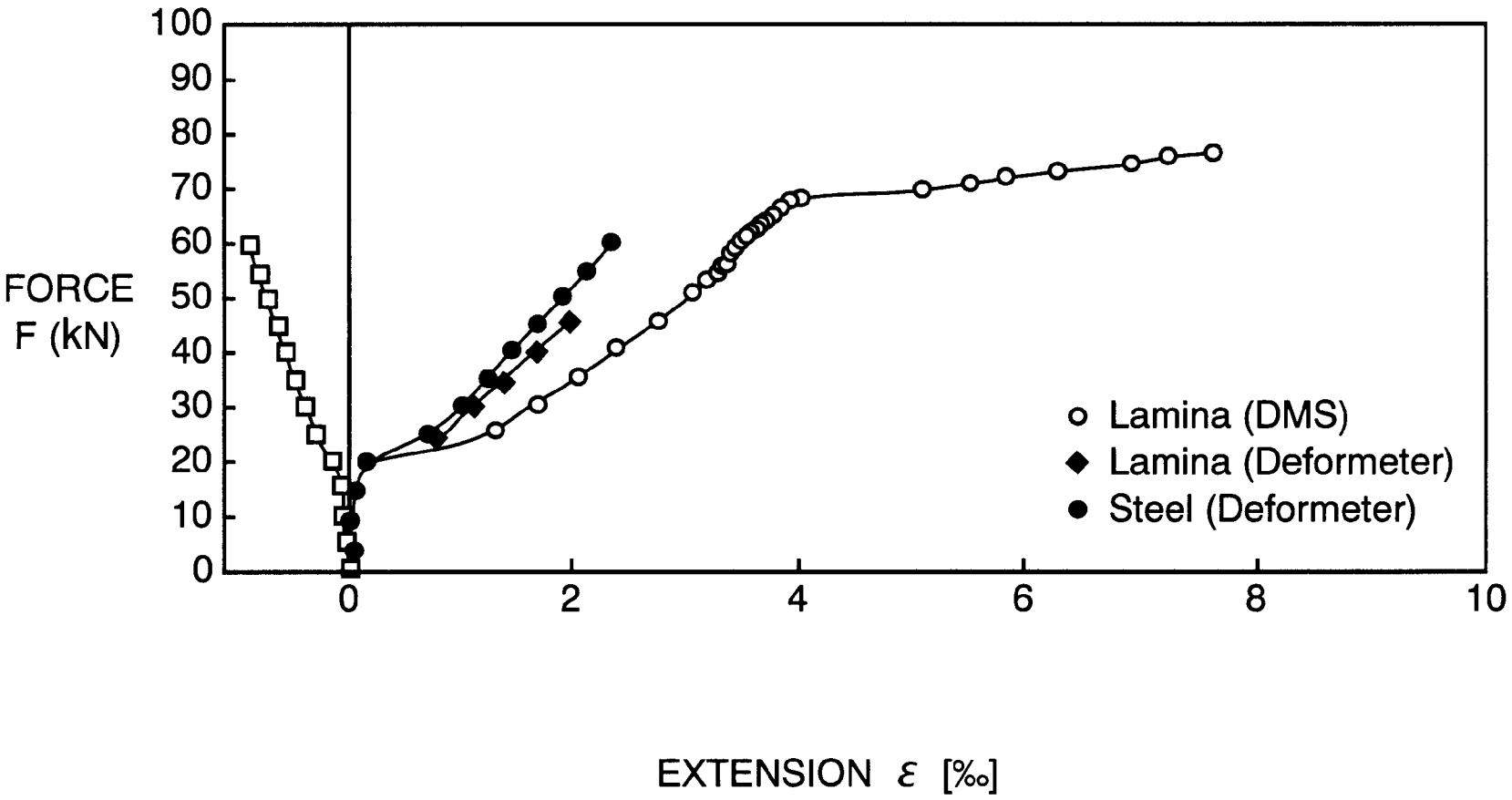

In each of the Figures a of FIGS. 9, 10 and 11 are shown the laminae extensions at the lamina end at different force stages for the three experimental arrangements of FIGS. 5, 6 and 7 as well as in the particular Figures b the extensions in the girder center.

In the following Table 1 for the three experimental arrangements the measured girder resistances the mean lamina tension in the girder center, as well as the type of failure of the girder are listed.

| Girder | Fmax[kNm] | σL (F) [N/mm$^2$] *) | Failure |
|---|---|---|---|
| FIG. 5 | 65 | 456 (60) | lamina start |
| FIG. 6 | 65 | 628 (65) | lamina start |
| FIG. 7 | 75 | 1'063 (75) | lamina start |

*) mean lamina tension in girder center

Discussion of the results or of the diagrams, respectively, according to FIGS. 8 to 11 as well as of Table 1:

The maximum load, and in particular the maximum lamina extension, in the experimental arrangement according to the invention according to FIG. 7 could be increased significantly relative to the girders of the experimental arrangements 5 and 6. In spite of different anchoring lengths in the region of ends 13' and 13", the girders according to FIGS. 5 and 6 exhibit similar behavior. In the central girder region the same extensions are registered. {Each of} The laminae shear off the lamina end when they reach yield load.

The lamina of the girder according to the arrangement suggested according to the invention in FIG. 7 is set at one end 13'" into the concrete girder 3 and covered with adhesive agent 23. The maximum lamina extensions could be markedly increased relative to the experiments described above in connection with the arrangements according to FIGS. 5 and 6. This behavior can presumably be explained as follows:

Deflection of the resulting tension components perpendicularly to the affixed lamina. Therewith the lamina is pressed on generating compression tensions in the concrete. With corresponding ideal and optimized geometry of the end segment 13*a*'" extending into girder 3 pressing of the lamina onto the girder can be achieved, which is comparable to the effect of the transverse tension described in the International Patent Application WO 93/20296.

Figure 13A:
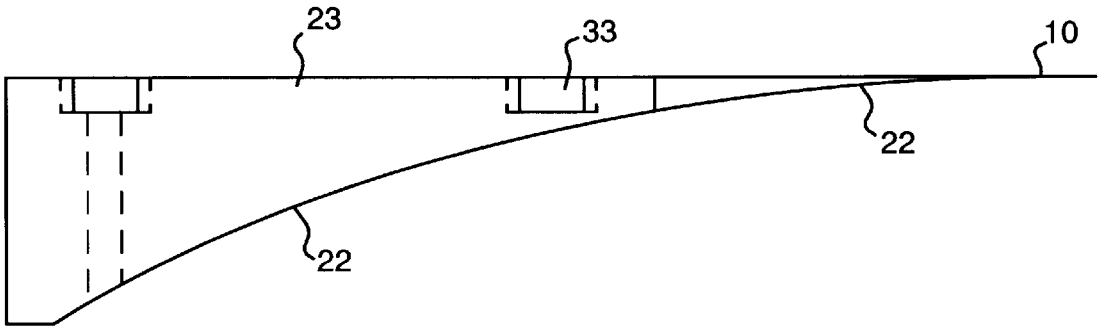
FIGS. 13*a* and 13*b* are respective longitudinal section and top views of the disposition of an end edge on a lamina end anchored according to the invention.

The adhesive agent on the lamina or a pressing wedge according to FIG. 3 or the subsequent FIGS. 13*a* and *b* prevents the untimely detachment of the lamina end caused by the perpendicular tension component directed away from the girder.

By means of the experimental arrangements in FIGS. 5 to 7 thus it can emphatically be shown that through the terminal anchoring according to the invention extending into the structure, of the reinforcement laminae a significantly increased reinforcement on the structure can be attained compared to a reinforcement lamina of equal or greater length, whose corresponding end is not anchored according to the invention so as to extend into the structure but rather, as known from prior art, is affixed [by adhesion] along a significantly longer anchoring path onto the structure or is anchored in contact on the latter, respectively.

Figure 12B:
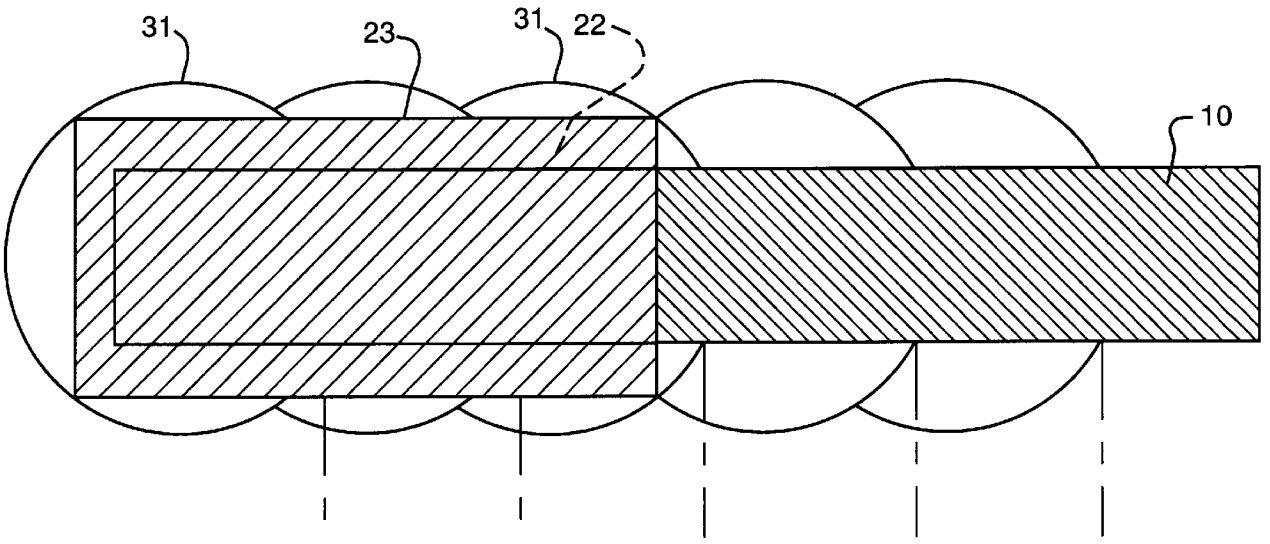
Figure 12A:
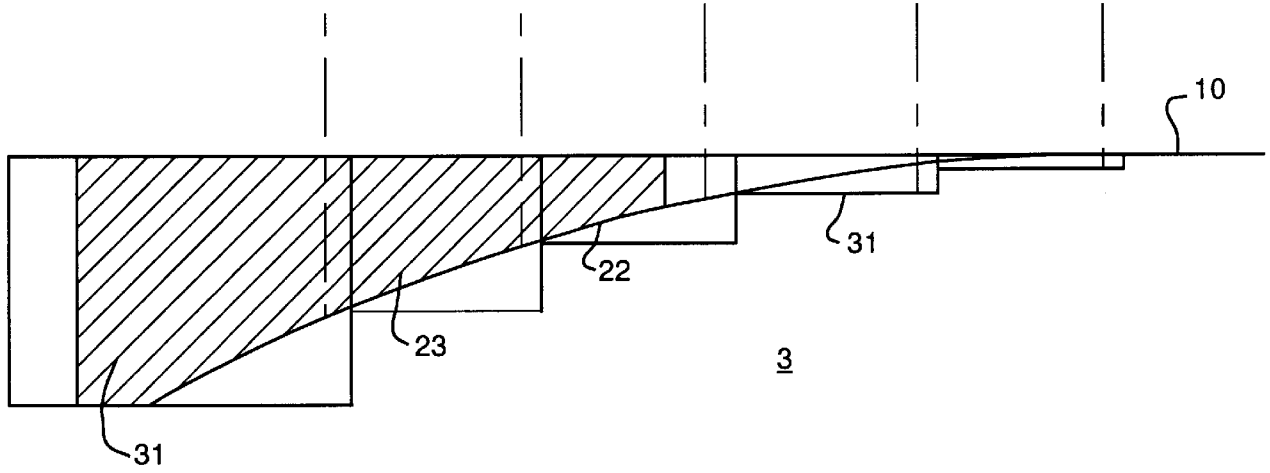

In FIGS. 12*a* and 12*b* a method is depicted schematically of the way in which the terminal anchoring according to the invention of a reinforcement lamina 10 is possible relatively simply. As a rule, grinding-in, milling-in or grinding-off into the structure is not possible so that, as shown in FIGS. 12*a* and 12*b,* it is suggested to accomplish the terminal extension into the structure of the reinforcement lamina end 22 by means of so-called stepped-off core bores. Thus in the terminal region so-called core bores 31 are stepped-off by means of for example a conventional drilling machine into the concrete 3 to be reinforced, wherein the first bore removed from the lamina end has only a low depth while the last core bore 31 in the region of the lamina end has a great depth. Such core bores can have, for example, a hole diameter of 10 or more cm, depending on the width of the reinforcement lamina 10 to be anchored. After the disposition of the lamina end 22 such that it extends into the structure, an anchoring wedge 23 can again be placed, as described in FIG. 3.

Figure 13B:
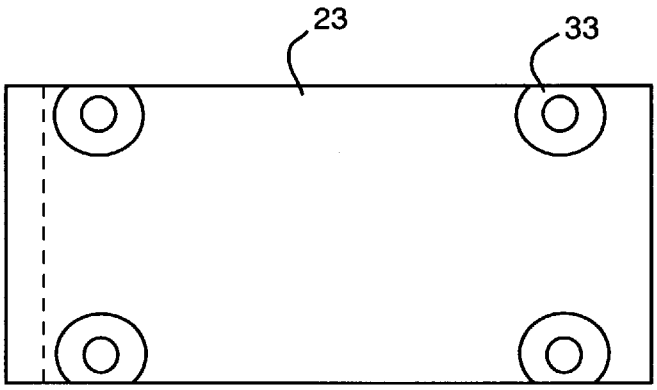

Such anchoring wedge is also depicted in FIGS. 13*a* and 13*b,* wherein now additional fastening means 33 are disposed, which can be, for example, screws, bolts, loops etc. By means of these securing means 33 the anchoring effect of the wedge 23 onto the lamina end 22 is additionally augmented. FIG. 13*a* shows the wedge 23 in longitudinal section while FIG. 13*b* represents a top view onto wedge 23.

Figure 14A:
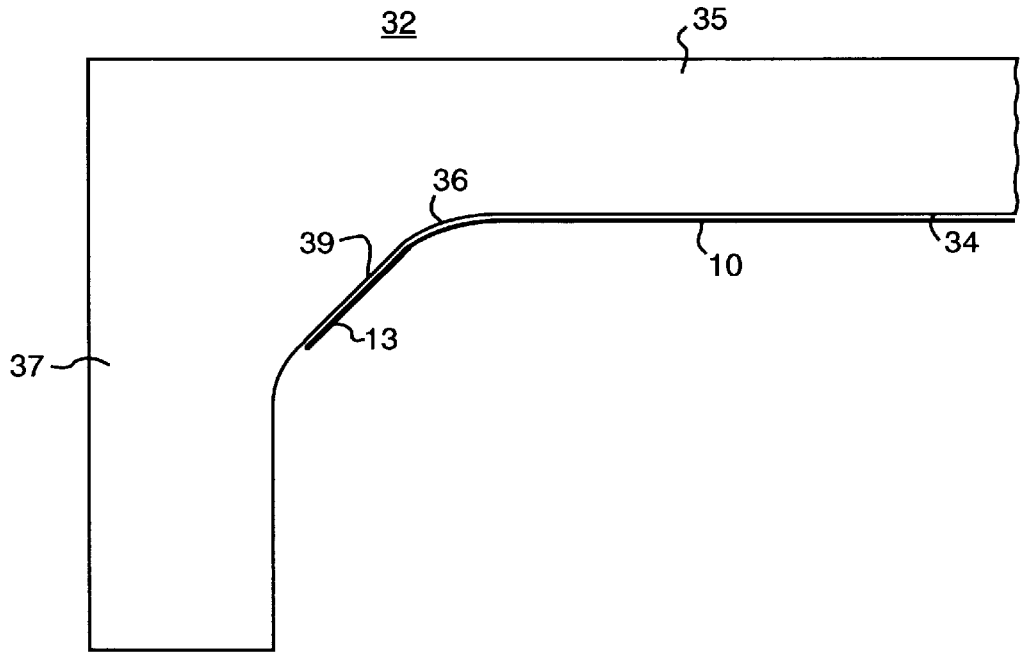
FIG. 14A (PRIOR ART)
FIGS. 14*a* and 14*b* shows conjunction with a concrete haunch in respective longitudinal section views the problems of the disposition of a reinforcement lamina and the corresponding solution according to the invention.
Figure 14B:
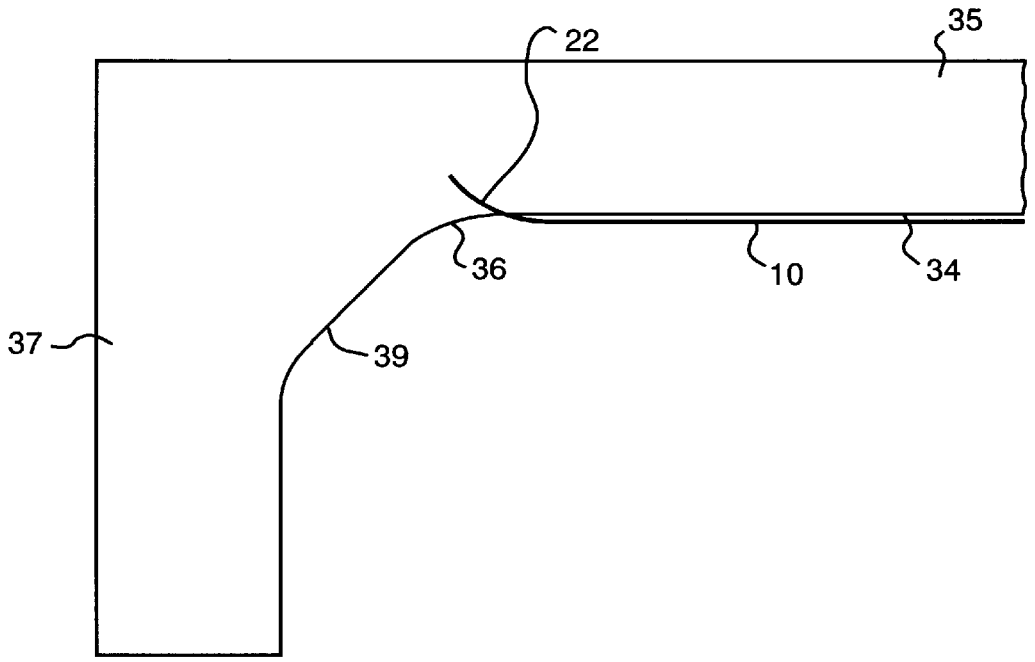

In FIGS. 14*a* and 14*b* a concrete structure 32 is shown such as for example a bearing structure in galleries or tooling halls, in which structure the ceiling plate 35 and the side wall 37 are connected with one another in the corner region across a so-called haunch 39. If the underside of the ceiling 35 is to be reinforced by means of a reinforcement lamina 10, it is clearly evident in FIG. 14*a* that the anchoring of the lamina end 13 in the region of the haunch is unfavorable since upon the occurrence of tension forces [acting] onto the reinforcement lamina 10 the latter becomes detached in the corner region 36.

As shown in FIG. 14*b,* for this reason it is suggested according to the invention to anchor the reinforcement lamina 34 or its end 22, respectively, in the comer region 36 in such a way that it extends into the concrete ceiling 35. When the concrete ceiling 35 is under load, the tensile stress component due to the bending moment onto the lamina in the end region of the lamina is deflected into the ceiling which prevents the lamina end 22 from becoming detached.

Figure 15:
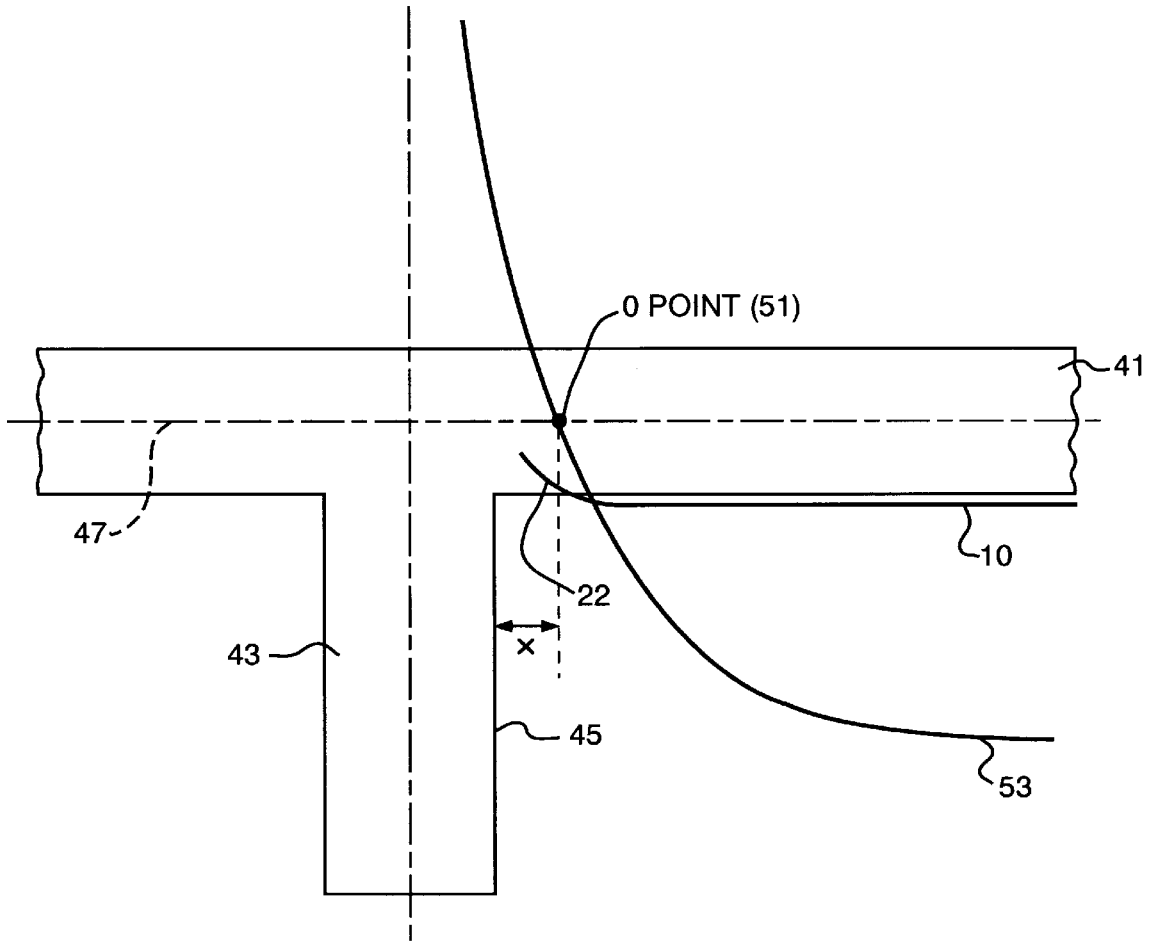
FIG. 15 is a further structural arrangement in longitudinal section, which is reinforced.

Lastly, FIG. 15 depicts a further structural arrangement, for example again a bearing structure, comprising a concrete ceiling 41 as well as a partition wall or a longitudinal pier 43, wherein again the ceiling 41 is reinforced by means of a reinforcement lamina 10. In the comer region 45, between ceiling 41 and pier 43, is anchored according to the invention the lamina end 22 such that it extends into the ceiling.

In conjunction with the auxiliary line 53 drawn in FIG. 15 the course of the bending moment with respect to the structural component or to the system center plane 47 extending through the ceiling is shown. Therein is clearly evident the passage through a zero point at distance x from the pier 43 near the corner region 45 and a subsequent strong increase. Through the anchoring according to the invention of the lamina end 22 at interval range x where no tension force occurs, it is already possible starting at the zero point to absorb fully the subsequently generated tension stress through the reinforcement lamina 10. In the event that the reinforcement lamina 10, affixed [by adhesion] as usual, were anchored in the corner region 45, an absorption of the generated tension stress would only be possible at a distance greater [than] x from the corner region 45, whereby the danger of shearing-off of the lamina 10 from the concrete ceiling 41 is given.

FIGS. 1 to 15 serve only for the further explanation and illustration of the concept according to the invention and it is understood that the terminal anchoring suggested according to the invention, of reinforcement laminae can be selected to be any desired one. The material used for the reinforcement laminae can also be any desired material, thus a lamina can be comprised for example of sheet iron, steel, aluminum, a reinforced polymer, such as in particular a GFK-reinforced epoxy resin, etc. Essential to the invention is the fact that a reinforcement lamina applied or affixed on a structure or masonry is anchored so as to extend at least with one end into the structure or masonry, respectively; whether or not therein a reinforcement wedge is used is not of primary significance and depends on the requirements and the locality.

We claim:

1. An arrangement for reinforcing a structural component having a surface, comprising, in combination with the structural component, and elongated lamina strip adhered to the surface and having opposite ends;

the surface of the structural component having a recess adjacent at least one of the ends of the lamina; and at least one end of the lamina extending into the recess and terminating at an end of the recess for reinforcing the structural component.

2. An arrangement according to claim 1, including adhesive filler filling the recess and covering a portion of the end of the lamina extending into the recess.

3. An arrangement according to claim 2, wherein the recess curves into the surface of the structural component and has an end which is substantially transverse to the surface, the lamina curving so that the end of the lamina curves into the recess and engages the end of the recess.

4. An arrangement according to claim 1, wherein the recess curves into the surface of the structural component and has an end which is substantially transverse to the surface, the lamina curving so that the end of the lamina curves into the recess and engages the end of the recess.

5. An arrangement according to claim 1, when the lamina is curved so that the end of the lamina curves into the recess, the end of the lamina being covered in the recess by a material selected from the group consisting of: concrete, cement, mortar or polymer-reinforced adhesive.

6. An arrangement according to claim 1, wherein the lamina is made of material selected from the group consisting of: iron, steel, aluminum or fiber-reinforced polymer.

7. An arrangement according to claim 6, wherein the recess curves into the surface of the structural component and has an end which is substantially transverse to the surface, the lamina curving so that the end of the lamina curves into the recess and engages the end of the recess.

8. An arrangement according to claim 1, including means for pressing the end of the lamina into the recess.

9. An arrangement according to claim 8, wherein the means for pressing the end of the lamina is selected from the group consisting of: a wedge, a plate, an additional lamina or a truss-chord.

10. A method of reinforcing a structural component having a surface, comprising:

providing a recess in the surface having a curved entry portion and an end which is substantially perpendicular to the surface;

adhering an elongated lamina to the surface with an end of the lamina extending over the recess; and bending the lamina end into the recess so the lamina end is braced against the end of the recess and is bent along the curved entry portion of the recess.

11. A method according to claim 10, including covering the end of the lamina which is in the recess with adhesive fixing material.

12. A method according to claim 11, wherein the adhesive fixing material is selected from the group consisting of: concrete, cement, mortar and reinforced polymer.

13. A method according to claim 10, including pressing the end of the lamina into the recess by mechanical means.

14. A method according to claim 13, wherein the mechanical means are selected from the group consisting of: a wedge, a plate, a further lamina and a truss-chord.

* * * * *